US006497986B1

(12) United States Patent
Aylward et al.

(10) Patent No.: US 6,497,986 B1
(45) Date of Patent: Dec. 24, 2002

(54) NACREOUS SATIN IMAGING ELEMENT

(75) Inventors: Peter T. Aylward, Hilton, NY (US); Robert P. Bourdelais, Pittsford, NY (US); Alphonse D. Camp, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/931,328

(22) Filed: Aug. 16, 2001

(51) Int. Cl.[7] ..... G03C 1/765; G03C 1/91; G03C 1/93; G03C 1/76; G03C 8/52

(52) U.S. Cl. ..... 430/220; 430/496; 430/510; 430/523; 430/536; 430/533; 430/961; 347/106

(58) Field of Search ..... 430/11, 14, 220, 430/496, 523, 533, 536, 961, 510; 347/106

(56) References Cited

U.S. PATENT DOCUMENTS

| | | | | |
|---|---|---|---|---|
| 4,216,018 A | | 8/1980 | Bilofsky et al. | 430/220 |
| 4,269,916 A | | 5/1981 | Bilofsky et al. | 430/220 |
| 4,288,524 A | | 9/1981 | Bilofsky et al. | 430/220 |
| 4,579,810 A | * | 4/1986 | Johnson et al. | 430/536 |
| 4,910,235 A | * | 3/1990 | Satakel et al. | 523/171 |
| 5,340,692 A | | 8/1994 | Vermeulen et al. | 430/233 |
| 5,466,519 A | | 11/1995 | Shirakura et al. | 430/538 |
| 5,733,658 A | | 3/1998 | Schmid et al. | |
| 5,858,078 A | | 1/1999 | Andes et al. | |
| 5,866,282 A | | 2/1999 | Bourdelais et al. | 430/536 |
| 5,888,681 A | | 3/1999 | Gula et al. | 430/536 |
| 6,030,759 A | | 2/2000 | Gula et al. | 430/536 |
| 6,071,654 A | | 6/2000 | Camp et al. | 430/536 |
| 6,071,680 A | | 6/2000 | Bourdelais et al. | 430/536 |
| 6,165,700 A | * | 12/2000 | Camp et al. | 430/496 |

FOREIGN PATENT DOCUMENTS

| | | |
|---|---|---|
| JP | 61/259246 | * 11/1986 |

OTHER PUBLICATIONS

Derwent Abstr of JP 61/259,246 Nov. 1986.*

J Pab Abstr. of JP61/259,246 Nov. 1986.*

* cited by examiner

*Primary Examiner*—Richard L. Schilling
(74) *Attorney, Agent, or Firm*—Paul A. Leipold

(57) ABSTRACT

The invention relates to a photographic element comprising nacreous pigment.

14 Claims, No Drawings

NACREOUS SATIN IMAGING ELEMENT

FIELD OF THE INVENTION

This invention relates to imaging materials. In a preferred form, it relates to nacreous photographic reflective paper.

BACKGROUND OF THE INVENTION

Prior art reflective imaging output materials such as silver halide reflective images or ink jet reflective images typically comprise imaging layers applied to a white reflective base material. The white reflective base reflects ambient light back to the observer's eye to form the image in the brain. Prior art base materials typically utilize white reflecting pigments such as $TiO_2$ or $BaSO_4$ in a polymer matrix to form a white reflective base material. Prior art reflective photographic papers also contain white pigments in the support just below the silver halide imaging layers to obtain image whiteness and sharpness during image exposure, as the white pigment reduces the amount exposure light energy scattered by the cellulose paper core. Details on the use of white pigments in highly loaded coextruded layers to obtain silver halide image sharpness and whiteness are recorded in U.S. Pat. No. 5,466,519.

It has been proposed in U.S. Pat. No. 5,866,282 (Bourdelais et al) to utilize a composite support material with laminated biaxially oriented polyolefin sheets as a photographic imaging material. In U.S. Pat. No. 5,866,282, biaxially oriented polyolefin sheets are extrusion laminated to cellulose paper to create a support for silver halide imaging layers. The biaxially oriented sheets described in U.S. Pat. No. 5,866,282 have a microvoided layer in combination with coextruded layers that contain white pigments such as $TiO_2$ above and below the microvoided layer. The composite imaging support structure described in U.S. Pat. No. 5,866,282 has been found to be more durable, sharper and brighter than prior art photographic paper imaging supports that use cast melt extruded polyethylene layers coated on cellulose paper.

It has been proposed in U.S. Pat. No. 6,071,680 (Bourdelais et al) to utilize a voided polyester sheet coated with light sensitive silver halide imaging layers for use as photographic output material. The voided layer in U.S. Pat. No. 6,071,680 improves opacity, image lightness, and image brightness compared to prior art polyethylene melt extrusion coated cellulose paper base materials. The image base proposed in U.S. Pat. No. 6,071,680 also contains an integral polyolefin skin layer to facilitate imaging layer adhesion at the time of manufacture and during the processing of silver halide imaging layers.

There, however, remains a continuing need for improvements to the appearance of imaging output materials. It has been shown that consumers, in addition to reflective output material, also prefer nacreous images. Nacreous images exhibit a pearly or nacreous luster, an iridescent play of colors, and a brilliant luster that appears in three dimensions. Nacreous appearance can be found in nature if one examines a pearl or the polished shell of *Turbo marmoratus*.

A nacreous photographic element with a microvoided sheet of opalescence is described in U.S. Pat. No. 5,888,681 (Gula et al). In U.S. Pat. No. 5,888,681 microvoided polymer sheets with microvoided polymer layer located between a cellulose paper base and developed silver halide imaging provide an image with an opalescence appearance. The nacreous appearance is created in U.S. Pat. No. 5,888,681 by providing multiple internal reflections in the voided layer of the polymer sheet. While the opalescence appearance is present in the image, the image suffers from a loss of image sharpness or acutance, a higher density minimum position, and a decrease in printing speed compared to a typical photographic image formed on a white, reflecting base. It would be desirable if the opalescent look of the image could be maintained while improving printing speed, increasing sharpness, and decreasing density minimum. Also, while the voided polymer does provide an excellent nacreous image, the voided layer, because it is pre-fractured, is subjected to permanent deformation, thus reducing the quality of the image. The image obtained from this invention have a strong glossy in appearance which is desirable in some situations but in the field of fine art and portrait imaging, being able to eliminate the harsh glare in very desirable. In this area of imaging, a very soft appearance is very desirable. In the case of weddings, it is very difficult to capture the rich lustrous satin appearance and feel of a wedding gown when the imaging element has a high level of metallic like gloss.

In addition to the use of white pigments in reflective consumer photographs, white pigments are also utilized in photographic display materials for diffusion of illumination light source. While the use of white pigments in display materials does provide the desired diffusion and reflection properties, the white pigments tend to change the hue angle of the color dyes in a developed photographic display image. Dye hue angle is a measure in CIElab color space of that aspect of color vision that can be related to regions of the color spectrum. For color photographic systems there is a perceptual preferred dye hue angle for the yellow, magenta, and cyan dyes. It has been found that when photographic dyes are coated on support containing white pigments, the hue angle of the developed image changes compared to the hue angle of the dyes coated onto a transparent support. The hue angle change of photographic dyes caused by the presence of white pigments often reduces the perceived quality of the dyes compared to the dye set coated on a transparent base that is substantially free of white pigments. It would be desirable if a developed photographic dye set coated on a reflective support material had a dye hue angle that was not significantly different than the same dye set coated on a transparent support.

Nacreous pigments added to a matrix, such as paint or plastic, have been known to exhibit a nacreous appearance. The prior art use of the nacreous pigments have been for pigmenting paints, printing inks, plastics, cosmetics, and glazes for ceramics and glass. Nacreous pigments are dispersed in a matrix and then painted or printed onto a substrate. Pearl luster pigments containing titanium dioxide have been successfully employed for many years. They are constructed in accordance with the layer substrate principle, with mica being employed virtually without exception as substrate.

Mica pigments are used widely in the printing and coating industries, in cosmetology, and in polymer processing. They are distinguished by interference colors and a high luster. For the formation of extremely thin layers, however, mica pigments are not suitable, since the mica itself, as a substrate for the metal-oxide layers of the pigment, has a thickness of from 200 to 1200 nanometers. A further disadvantage is that the thickness of the mica platelets within a certain fraction defined by the platelet size in some cases varies markedly about a mean value. Moreover, mica is a naturally occurring mineral, which is contaminated by foreign ions. Furthermore, technically highly complex and time-consuming processing steps are required including, in particular, grinding and classifying.

Pearl luster pigments based on thick mica platelets and coated with metal oxides have, owing to the thickness of the edge, a marked scatter fraction, especially in the case of relatively fine particle-size distributions below 20 micrometers. As a substitute for mica, it has been proposed to use thin glass flakes that are obtained by rolling a glass melt with subsequent grinding. Indeed, interference pigments based on such materials exhibit color effects superior to those of conventional, mica-based pigments. Disadvantages, however, are that the glass flakes have a very large mean thickness of about 10–15 micrometers and a very broad thickness distribution (typically between 4 and 20 micrometers), whereas the thickness of interference pigments is typically not more than 3 micrometers.

In U.S. Pat. No. 5,340,692 (Vermeulen et al) an imaging receiving material with nacreous pigment for producing contone images according to the silver salt diffusion process is disclosed. According to the process disclosed in U.S. Pat. No. 5,340,692, contone images with an antique look can be obtained utilizing the silver salt diffusion transfer process without the need of special processing liquids using a nacreous pigment in the imaging receiving layer or located between the support and the image receiving layer. The silver halide imaging layers used are created with retained silver and, therefore, are not semitransparent. Because the nacreous pigments used are contained in the imaging receiving layer and not silver halide imaging layer, the image form will not have a uniform nacreous appearance, as the density of the transferred silver halide image block the multiple reflections from the nacreous pigments. Further, the nacreous pigments utilized are too large and in too great a concentration to be included in the silver halide imaging layer as a rough surface would result, reducing the desired nacreous appearance of the image. The gold flakes used in the example in U.S. Pat. No. 5,340,692 are an attempt to simulate prior art black-and-white photographic "Sepatone" appearance produced during a post process treatment of the imaging layers. While the image in the example does have an antique appearance, the image does not have a nacreous appearance.

In U.S. Pat. No. 4,269,916 (Bilofsky et al) and related patents U.S. Pat. No. 4,288,524 and U.S. Pat. No. 4,216,018, instant photographic products having reflective layers which comprise lemellar interference pigments are disclosed. The intended use of the lemellar pigments is to create a pleasing white reflective appearance for the base material without the need for blue tints. It has been proposed that flat particles of metal oxides created by coating salts with metal oxides and later dissolving the salts leaving a thin flake of metal oxide as a substitute for spherical $TiO_2$ particles. Titanium dioxide particles typically are utilized in photographic art to create a white reflective surface for the viewing of print materials. The intent of U.S. Pat. No. 4,269,916 is to provide a white reflecting surface that does not have an angular viewing appearance and a consistent L*, thus the invention materials do not exhibit a nacreous appearance. Examples in U.S. Pat. No. 4,269,916 show high reflectivity at a variety of collection angles which is opposite of a nacreous appearance where reflectivity changes as a function of collection angle. Further, the lemellar pigments are not present in the silver halide imaging layers or in the base materials used in the invention.

In U.S. Pat. No. 5,858,078 (Andes et al), a process for the production platelet like, substrate free $TiO_2$ pigment is disclosed for use in printing inks, plastics, cosmetics and foodstuffs is.

In U.S. Pat. No. 5,733,658 (Schmid et al) luster pigments obtainable by treating titania coated silicate based platelets from 400° C. to 900° C. with a gas mixture comprising a vaporized organic compound and ammonia are described as useful for coloring paints, inks, plastics, glasses, ceramic products, and decorative cosmetic preparations.

When imaging supports are subject to variations in ambient conditions over long periods of time, the image-containing layers and resin layers tend to deteriorate into a mass of cracks which are aesthetically undesirable and which, in extreme cases, extend over the entire print completely destroying the image. All polymers are inherently prone to chemical degradation that leads to loss of mechanical properties. They undergo thermal degradation during processing such as extrusion of thin films, and photooxidative degradation with long-term exposure to light. The TiO utilized in U.S. Pat. No. 5,858,078 and U.S. Pat. No. 5,733,658 catalyzes and accelerates both thermal and photooxidative degradation. In the art of resin coating imaging papers, the melt polymers are extruded at high temperatures and are also subjected to high shear forces. These conditions may degrade the polymer, resulting in discoloration and charring, formation of polymer slugs or "gels", and formation of lines and streaks in the extruded film from degraded material deposits on die surfaces. Also, thermally degraded polymer is less robust than non-degraded polymer for long-term stability, and may thereby shorten the life of the print.

It has been shown that when imaging layers (silver halide, ink jet, flexography, laser toner, and the like) are applied to nacreous base materials, the nacreous appearance of the image is optimized when the image forming layers contain semitransparent dyes. The use of pigmented inks and dyes in the imaging layers tend to reduce the nacreous appearance of the image. In U.S. Pat. No. 6,071,654 (Camp et al) silver halide imaging layers that are semitransparent are coated on a nacreous support containing a voided polymer layer. The voided polymer layers create flat platelets oriented parallel to each other. The reflection that reaches the eye is primarily specular. It arises in depth, since each transparent polymer platelet reflects some of the incident light and reflects the remainder. The images in U.S. Pat. No. 6,071,654 exhibit a nacreous appearance.

The use of upper surface roughness is described is U.S. Pat. No. 6,165,700 to provide a nonglossy photographic display material that utilizes biaxially oriented sheets for display purposes. The images on this material are matte and dull appearing. There remains a need for a non-glossy print material that has a lustrous sheen or satin appearance to the image.

PROBLEM TO BE SOLVED BY THE INVENTION

There is a need for a reflective imaging material that provides a lustrous satin sheen appearance without having to have a special base while, at the same time, maintains photographic sharpness or printing for photographic imaging and a deep rich satin sheen for other imaging methods.

SUMMARY OF THE INVENTION

It is an object of the invention to provide improved imaging materials.

It is another object to improve image appearance compared to prior art voided base imaging materials.

It is a further object to provide imaging materials that have a lustrous satin sheen independent of the base material.

These and other objects of the invention are accomplished by an imaging element comprising nacreous pigment and having a top surface roughness of between 0.2 and 2.0 micrometers.

ADVANTAGEOUS EFFECT OF THE INVENTION

The invention provides soft, subtle images that have a lustrous satin sheen that does not require a special base. The invention may be used with a variety of imaging methodologies and is particularly useful in better replicating the sheen of satin.

DETAILED DESCRIPTION OF THE INVENTION

The invention has numerous advantages over prior art imaging reflective materials. The reflective materials of the invention provide an image with a lustrous satin appearance while maintaining efficient reflection of light, sharpness, and photographic speed. Maintaining image sharpness and whiteness is important, as consumers expect professional images to be high in quality. Further, maintaining printing speed is critical for efficient photographic processing, as a significant loss in printer speed could increase the cost of consumer silver halide images. In the area of fine art imaging, special low light conditions help to enhance the mood that the professional is trying to capture. Having a print media that is capable of working in these conditions is important.

The lustrous satin imaging materials of the invention provide an eye appealing softness that make them particularly desirable for imaging applications that require capturing and conveying a feeling or mood that evokes a warm sense of serenity in the consumer. One example includes print materials that are intended to capture a moment in time. The satin images are differentiated in look from prior art materials and, thus, provide the warm sense of serenity that appeals to the consumer's emotions. By providing the lustrous satin image with a pressure sensitive adhesive, the tough, durable lustrous satin image can be applied to various surfaces, which is particularly desirable.

Photographic lustrous satin labels of the invention utilized in packaging markets enable a differentiated look and consumer appeal on store shelf. The utilization of the thin, flexible, and tough silver halide materials results in a packaging material having many superior properties. The packaging materials of the invention have a depth of image unsurpassed by existing packaging materials. The packaging materials suitable for use in this invention may be utilized with a variety of packaging materials that are suitable pressure sensitive labeling, such as shampoo bottles, hand cream, perfume bottles, and film boxes. These packaging materials, while having the advantage of superior image, are available on thin base materials that are low in cost while providing superior opacity and strength. The packaging materials of the invention, as they may be imaged by flash optical exposure or digital printing, have the ability to be formed in short runs and to be rapidly switched from one image to the next without delay.

The term "lustrous satin" refers to a pearly, luster, and non-metallic nacreous appearance with a subdued soft sheen. This may include a lustrous and somewhat iridescent effect that has a very low level of sheen. The lustrous satin effect is the result of interference pigments that are platelet-like in their structure. Typically these are elongated platelet-like structures of silicate-based materials such as mica, feldspar, and quartz with metal oxide coatings. These pigments tend to cause specular and diffuse reflection, and they also transmit some light. The use of lustrous pigments in the paint and printing industry are typically designed to create a variety of soft mood colors. These materials are typically coated with a matting agent to reduce glare. Special metal oxide coatings are applied to mica particles in very thin layers. This allows for some light to be refracted, while other light will transmit through to the near transparent layers of the mica particle to be refracted at a slightly different angle. Since these pigments are suspended in a binder polymer of yet another refractive index, there are multiple light refractions that create a lustrous appearance. In addition, the chemistry of the coating that is applied to the mica particles may be varied to create various colors. Metal oxide coatings that may be used in an embodiment of this invention include titanium, iron, chromium, barium, aluminum, zinc, zirconium, bismuth vanadate, nickel titanate, chromium titanate, lead, and others. While these produce some exciting colors, in the field of photography and imaging traditional print materials have a white background. Additionally, it should be noted that the thickness of the metal oxide coating on the mica may also impact the color. In a preferred embodiment of this invention the metal oxide coating on the mica particles may comprise titanium, aluminum, and/or barium. These materials are preferred because it is desirable to have a more traditional white background that can be achieved with many other nacreous pigments. The most preferred metal oxide is titanium because of its superior whiteness. Typically it is important to control the thickness of the metal oxide coating to less than 120 nanometers to achieve a blue white appearance.

With lustrous satin pigments used in imaging applications, it may be desirable to have non-uniform platelet thickness and small particles to create a white nacreous appearance. In imaging applications where a different look is desirable, the use of thicker particles and more uniform spacing of platelets to each other creates a color interference that is more characteristic of mother-of-pearl. In general, the lustrous pigments referred to in this invention are pigments that consist of flat mica platelets coated with titanium dioxide or other metal oxides. They are irregular in shape and may vary in thickness from 0.1 to 0.5 micrometers, although some individual particles may be thicker. The particles may have a length of up to 500 micrometers. The coating applied to the mica particles should be controlled in thickness, but the overall thickness is one parameter that controls the overall color appearance. Each transparent coating helps to create the lustrous or pearlescent effect. The particle of these pigments influences the perceived texture of the pearl luster effect and adds a new dimension of beauty and quality to the image. The coating may be colored with other compatible transparent pigments and dyestuffs. Metallic effects can be simulated by adding small amounts of carbon black with some silvery white pigments. The color observed is different than color pigments and dyes in that the color and lustrous iridescence is produced by light interference and not absorption or reflection of light. This is a suprisingly unique attribute to the field of silver halide photography and imaging. In those scenes where a soft mood is desired and the essence of satin is being captured, the use of lustrous stain pigments or the use of a slightly roughen surface may be necessary. With the use of lustrous satin pigments there are many refractive interface that can produce a unique appearance to an imaging element. A light ray striking a layer containing lustrous satin platelets must pass through a substantially transparent layer of relatively lower refractive index binder polymer surrounding the platelet, and then the ray is partially reflected by the metal oxide coating on the surface. The remaining part passes into the metal oxide coating layer and is again reflected as it exits the layer at the interface with the mica particle. Since the coating is very thin and the mica platelets are substantially transparent, the remaining light has many opportunities to be reflected at different angles. This helps to provide the luster nacreous appearance, as well as to add a three-dimensional quality to the image. The resulting color effect that is produced depends on the light reflection from the interfaces, as well as the type of coating on the mica particles. The multiple interfaces cause the reflected light to be slightly out of phase. It should also be noted that the color varies based on the angle of illumination and that an iridescence effect can be seen. Control of this effect is desirable depending on the effect that needs to be conveyed by the image. As noted above the thickness and type of the coating on the mica particles are factors that need to be considered. In addition the particle size can also be used to control the effect. For use in a photographic element it is desirable to have a suitable smooth surface. To achieve this, a small particle is best but the layer thickness of the binder polymer in which the pigments are suspended may also be increased as well as applying clear overcoats. The lustrous satin effect can be changed by adjusting the particle size, metal oxide coating thickness and type, as well as the concentration of the pigment. In general, low pigmentation levels are better at producing a three-dimensional effect. The lustrous satin effect may be enhanced by applying a thick but slightly roughened or hazy layer over the top of the lustrous pigments. Since light sensitive photographic layers produce dye couplers that are semitransparent and typically do not contain pigment particles; they are uniquely positioned to be able to create synergistic effects with the lustrous satin pigments. This is also true for dye-based inks and toner particles with a clear or semi-transparent polymer. Inorganic pigments on top of or mixed in with nacreous pigments tend to substantially reduce or eliminate the nacreous appearance.

The lustrous satin pigments are relatively stable and generally resistant to alkali and acids, as well as high temperature. They can be dispersed in most carrying (binder polymer) media. Since the particles are substantially transparent, the use of a carrying media that is also transparent provides the maximum effect. If a more translucent carrying media is used, more lustrous satin pigment may be needed to achieve the same level of lustrous appearance.

In some applications it may be desirable to also have a lustrous satin pigment that is also conductive. This has some unique advantages in the area of photography that uses light sensitive layers. Static accumulation and discharge can result in a fogged layer. Being able to provide a conductive path that helps to prevent the charge from building up is an important element for imaging media. This not only helps prevent light fogging of light sensitive layer, but also allows sheets to slide over each other and various equipment parts without static buildup or cling of one sheet to another. This type of pigment is also a means of adding conductivity to the emulsion side of a photographic element. Conductive lustrous pigments consist of an inter core of platelet mica that is coated with materials such as $TiO_2$, $SiO_2$ and further coated with an outer dense layer of conductive, inorganic mixed metal oxide. A typical material is antimony-doped tin dioxide. The elongated particles of mica are useful in providing a conductive pathway when particles are touching.

The origin of the beauty of a genuine pearl has been well documented. It is known that its luster and color come from the multiple smooth concentric layers of nacre, i.e., calcium carbonate layer, organic constituent (conchiolin) layer. Each of these layers partially reflects and transmits light. Hence, a sense of depth and luster is observed in the reflection. Pigments that try to simulate the visual effect of a pearl are pearlescent and have lustrous satin. The first nacreous pigment was the natural pearl. The commercial grades of lustrous pigments are made of thin transparent platelets of high refractive index. These pigments are so designed that multiple reflections and transmissions occur and, as a result, a sense of depth is obtained in the overall reflected image. The characteristics of the pigment determine whether color is produced by light interference (specifically called as interference pigments) or no color is produced (called as white nacreous pigments).

Some of the earliest pearlescent pigments were the plate-like bismuth oxychloride crystals, and basic lead carbonate. These pigments reflect light similar to a pearl essence crystal. Due to toxicity of lead, bismuth oxychloride (BiOCl) crystals have seen an increased use in the marketplace. BiOCl is generally crystallized from solution into smooth, thin platelets, which has a particle size ranging from 5 micrometer and 15 micrometer.

The other commonly used pearlescent pigments are those made from mica coated with either titanium dioxide (U.S. Pat. No. 4,040,859), iron oxide (U.S. Pat. No. 3,087,829), zirconium dioxide (U.S. Pat. No. 3,087,828), or other high refractive index materials. Mica is used because it is transparent to light and can be cleaved into extremely thin flakes. Examples of mica suitable for pearlescent pigments are muscovite, paragonite, phlogopite, biotite, and lepidolite. The mica platelets are then coated with a thin single layer or multiple layers of high refractive index inorganic oxide. The reflection efficiency depends to a large extent on the refractive index difference between the mica platelet and the inorganic oxide coating. This layered structure enables it to function like a pearlescent pigment. The oxide coating provides the optical effects like luster, interference reflection color (if oxide coating is sufficiently thick) and absorption color (if the oxide contains color material). The size of the mica particle also plays an important role in determining the final reflected image. The weight of the mica in the pigment usually lies between 40% and 90% and most usually in the range of 60% and 80%. If titanium dioxide is used as the coating and its coating thickness is increased, then an iridescence effect (color) is observed. The dimensions of pearlescent pigments used in this invention may be between 5 micrometer and 400 micrometer and preferably between 5 micrometer and 100 micrometer because particles less than 5 micrometer are not very efficient in creating the nacreous appearance, while particles greater than 100 micrometer progressively get rougher. Controlled roughness on the surface is important in reducing harsh glare and helping to enhance the lustrous satin appearance. The thickness of the pigment is preferably between 0.1 micrometer and 0.6 micrometer and more preferably between 0.2 micrometer and 0.4 micrometer. Particles less than 5 micrometer or less than 0.2 micrometer typically do not have sufficiently higher nacreous appearance, while particles greater than 400 micrometer in length or 0.6 micrometer in width typically are very large and tend to create roughness which starts to shut down the nacreous effect. To create the lustrous satin appearance, a low-level surface roughness on the upper surface of the imaging element is desirable to eliminate the harsh metallic reflection obtained from a very smooth imaging element surface.

Other optically variable pigments that are suitably used are silicon oxide coated with thin layers of aluminum (5 nanometer and 10 nanometer) or titanium dioxide, and magnesium fluoride crystals coated with chromium have also been used. These pigment structures have been highlighted in U.S. Pat. No. 3,438,796. New optically variable pigment structures based on coated platelet like metallic substrates have been disclosed in U.S. Pat. No. 5,364,467 and U.S. Pat. No. 5,662,738. U.S. Pat. No. 5,976,511 discloses pigments composed of barium sulfate particles and coated with zinc oxide, cerium oxide, or titanium dioxide which have a pearly luster.

The imaging elements of this invention may utilize an integral emulsion bonding layer that allows the emulsion to adhere to the support materials during manufacturing and wet processing of images without the need for expensive subbing coatings.

The terms as used herein, "top", "upper", "emulsion side", "image side" and "face" mean the side or toward the side of a imaging member bearing the imaging layers. The terms "bottom", "lower side", and "back" mean the side or toward the side of the imaging member opposite from the side bearing the photosensitive imaging layers or developed image. Nacreous and lustrous satin appearance is a pearly, luster, iridescent sheen. A characteristic property of a lustrous satin appearance is an angular dependence of viewing angle that has a soft rich shimmer associated with the appearance.

For the imaging element of this invention, imaging layers are generally applied to a white reflective base, and the image layers comprise lustrous satin materials. In the invention a preferred embodiment is an imaging element comprising nacreous pigment and having a top surface roughness of between 0.2 and 2.0 micrometers. This embodiment is preferred because said imaging element that comprises nacreous pigment with a top surface roughness has a unique pearly lustrous stain appearance. Such an imaging element has a unique capability to preserve images with special luster sheen that is not available in traditional photographs or other images. A preferred embodiment of this invention comprises nacreous material in a photographic layer that is on a white reflective base. The white reflective base provides an excellent surface and background while viewing prints. In particular, it is desirable to have a white reflective base that has an L* of greater than 92. L* greater than 92 are desirable because they provide good contrast to the image and are pleasing to the viewer. L* or lightness and opacity were measured for using a Spectrogard spectrophotometer, CIE system, using illuminant D6500. In a further embodiment of this invention said imaging element comprising a nacreous pigment and with a top surface roughness as stated above has a surface gloss of between 6 and 30 20° Gardner units. A gloss in this area provides a sheen that in combination with the lustrous satin pigments provides a rich warm look to the imaging element.

In this invention the nacreous pigments may comprises between 0.5 and 1000 mg/m$^2$ of the photographic element. Nacreous pigment levels below 0.5 mg/m$^2$ are difficult to detect and generally do not have a nacreous impact. Nacreous pigment levels above 1000 mg/m$^2$ do not have a proportional improved nacreous appearance for the additional expense. Furthermore, if the level is above 1000 mg/m$^2$, the nacreous pigments tend to stack more vertically and their impact is decreased. In a preferred embodiment of this invention, said nacreous pigments are present in the amount between 7 and 250 mg/m$^2$. Below 7 mg/m$^2$ the nacreous appearance is more difficult to see, while levels above 250 mg/m$^2$ do not have a significantly improved nacreous appearance for the additional expense. When nacreous pigments are incorporated in and/or above silver halide layers, the amount of the nacreous pigment should be kept low to minimize interference with the image exposure. The amount may be adjusted to create unique artistic effects. Higher level in the preferred range tend to have a stronger nacreous appearance which is desirable in certain applications for display or youth markets where a different look is valued. In the preferred embodiment of this invention, the nacreous pigment should comprise between 0.1 to 9% by volume of the photographic emulsion. Levels below 0.1% have minimal nacreous appearance, while levels above 9% cause excessive stacking of the platelets which tends to interfere with the nacreous appearance. Additionally it is desirable to have the nacreous pigments as the only pigment in a substantial clear polymer. The inclusion of other solid particles tends to cause more light scattering and, therefore, reduces the nacreous effect.

Nacreous or pearlescence appearing media has been shown to be highly desirous from a commercial display standpoint. Lustrous satin appearance has a strong appeal in the fine arts segment of imaging. While a variety of nacreous pigments and or voids may be used, to obtain a low luster it may be desirable to incorporate a roughening frequency on the surface to substantially reduce harsh glare on the surface. Incorporation of nacreous pigments in a substantially transparent substrate or construction of composite materials containing localized voiding of a specific geometry, orientation, and formulation can produce both "colored" nacreous and "white" nacreous media. For both types, this nacrescence results in perceived depth, luster, and a metallic appearance. Correct measurement of these materials is required for robust design. Typically voided polymer layers are white and are diffuse or near opaque. When using voided polymers, they should be located below the nacreous pigment and also below the image.

For both pigment and voiding methods, "white" nacreous luster is a function of the orientation, as well as the spacing and composition of the materials. The luster and depth appearance of the media are mainly due to the reflected light that reaches the eye. Both pigments and voids that provide a nacreous appearance function as platelets oriented parallel to each other. This results in depth as each platelet reflects some of the incident light while transmitting the rest. Any imperfections due to surface defects or platelet or void orientation misalignments will cause the light to be scattered in a non-specular direction, and will degrade the nacreous appearance of the material.

In addition, the natural tendency for randomness in regards to platelet or void alignment and spacing will render the media incapable of producing color by light interference. Any color produced by one alignment and spacing will have a tendency to be counteracted by other encountered alignments and spacing. However, gross geometric misalignments of the platelets or voids will also result in less than desirable functionality, and a method of measuring this defect is required as well.

FLOP is a test method used to measure the nacreous quality of materials of interest. 45-degree incident light is collected at 10, 45, and 110 degrees from the specular reflection angle. The spectrophotometric output, e.g., CIE L* (L1*, L2*, L3 * respectively) is used as follows:

$$FLOP=15\ (L1^*-L3^*)^{111}/L2^{*0.86}$$

whereby FLOP values between less than 10 have no nacreous appearance and FLOP values greater than 10 are indicative of a nacrescent appearance.

Furthermore, quality monitoring of these nacreous materials, when combined with one or more semitransparent color forming dyes layers, places limitations on the usefulness of measurements taken with typically found reflection densitometers having 0/45 geometry. This is due to the angular dependency of these media. This angular viewing dependency of the media and the inherent randomness of the structure will result in errors "reading out" the dye formed due to the variability of the media at any one collection angle. These highly specular and translucent materials will reflect some light in angular dependent non-specular directions as well. It has been found that although incident light and collection at 0/45 will allow for a prediction of density minimum versus FLOP, these values are no longer predictive, as density increases from density minimum to density maximum as color dye forming layers are added to the media.

This can be explained as a function of the dye density. As density increases, the ability for multiple reflections through the media decreases. As the reflection passes approach one, the nacreous look will no longer be apparent.

Spectrogoniometric measurements can be employed to measure the media at various angles, but spectrogoniometric readings are tedious and the apparatus is expensive. An alternative for quality monitoring purposes to assess the amount of color forming layers coated and subsequently processed would be useful. During a color photographic coating operation, the need to reduce inherent manufacturing variability of color forming coupler levels is required and this data collection by conventional reflection 0/45 densitometry is impeded by the natural variability found in the nacreous media. Slight changes in the reflective properties of the base media will result in more or less light reaching the densitometer which, in turn, can result in an erroneous readout of the formed dye.

One such method to provide correct assessment during a coating operation would be to remove the nacreous properties of the media. This can be accomplished by collecting light from the prepared sample at a grazing angle that would minimize the nacreous layer contributions. Diffuse 8 degree sphere optical geometry handheld spectrophotometers have been shown to meet this need.

In a preferred embodiment of this invention an imaging element comprising a nacreous pigment and a top surface roughness between 0.2 to 2.0 micrometers has a flop measurement of between 4 and 25. Imaging elements with a flop greater than 25 tend to become more and more glossy which produce a strong harsh reflection. In those applications that are conveying a soft subtle message or trying to capture the essence of a soft shimmering lustrous satin, high levels of FLOP or gloss are not desirable. For imaging elements with Flop measurements below 4, it becomes difficult to see the lustrous effect.

In an embodiment of this invention said imaging element comprises at least an image receiving layer, a layer comprising nacreous pigment, and a base substrate. Since one application of this invention is in the field of fine art imaging, a preferred embodiment has a base substrate with a b* of between 7.0 and −7.0. Substrates with a b* in this range may provide a rich warm cream white color to a cool blue white. A b* below 7.0 tend to become very yellow and lose their appeal while b*'s greater than −7.0 are dark and blue and are not overly desirable.

One means to provide a top surface with the desired roughness that produces the low-level sheen, is to provide the roughening from the substrate below the surface. In one embodiment of this invention the base substrate of the imaging element has a top surface roughness of between 0.3 and 2.2 micrometers. Since the roughness of this embodiment is developed from the substrate surface below the imaging receiving layer, there may be a slight dampening of the roughness.

An additional embodiment of this invention said nacreous pigment is in said image receiving layer. In a preferred embodiment of this invention said nacreous pigment comprises more than one layer. Having more than one layer with nacreous pigment provides an imaging element with the opportunity to have the pigments in the base substrate as well as the image receiving layer. Such an imaging element would provide a unique look as well as having the ability to use nacreous pigments with more than one particle size. When this is combined with an upper surface roughness, a low level satin sheen is observed.

When the nacreous pigment is incorporated below the image receiving layer and the top surface of the imaging element has the desired roughness characteristics; any imaging technology may be used. In one preferred embodiment, the image-receiving layer comprises silver halide. This embodiment is preferred because photographic images are very effective in capturing very soft moods when combined with a lustrous satin appearance, provides a surprisingly unique image recording media.

In an embodiment of this invention said top surface roughness of the imaging element is between 0.2 and 2.0 micrometers comprises particles with a size of between 0.2 and 15.0 micrometers. Particles integral to the top surface are desirable because their concentration level may be adjusted to create the desired amount of roughness. Particles below 0.2 micrometers are very small and tend not to influence the lustrous sheen while particles greater than 15.0 micrometers create excessive roughness and tends to shut down the lustrous satin effect. In a preferred embodiment of this invention said top surface roughness of between 0.2 and 2.0 micrometers comprises a material selected from the group consisting of silica, silicon dioxide, glass beads, at least two or more immessible polymers. These materials are preferred because they provide good control of the surface roughness and are compatible with a variety of imaging element and image receiving layers.

In a preferred embodiment of this invention said top surface roughness of between 0.2 and 2.0 micrometers comprises silica in an amount between 25 $mg/m^2$ and 400 $mg/m^2$. Levels of silica below 25 $mg/m^2$ typically have a harsh glare while levels above 400 $mg/r^2$ become very matte and eliminates the lustrous satin effect.

The imaging elements of this invention are in a preferred form photographic elements, such as photographic display films, photographic paper, or photographic glass plates, in which the image-forming layer is a radiation-sensitive silver halide emulsion layer. Such emulsion layers typically comprise a film-forming hydrophilic colloid. The most commonly used of these is gelatin, and gelatin is a particularly preferred material for use in, this invention. Most of the nacreous pigments useful in this invention are easily dispersed in gelatin. Additional dispersing aids may be used with gelatin or other hydrophilic colloids. Most any aqueous dispersing aid known in the art of pigments and paints may be useful. Useful gelatins include alkali-treated gelatin (cattle bone or hide gelatin), acid-treated gelatin (pigskin gelatin), and gelatin derivatives such as acetylated gelatin, phthalated gelatin, and the like. Other hydrophilic colloids that can be utilized alone or in combination with gelatin include dextran, gum arabic, zein, casein, pectin, collagen derivatives, collodion, agar-agar, arrowroot, albumin, and the like. Still other useful hydrophilic colloids are water-soluble polyvinyl compounds such as polyvinyl alcohol, polyacrylamide, poly(vinylpyrrolidone), and the like.

The preferred photographic elements of the present invention can be simple black-and-white or monochrome elements comprising a support bearing a layer of light-sensitive silver halide emulsion, or they can be multilayer and/or multicolor elements.

Color photographic elements of this invention typically contain dye image-forming units sensitive to each of the three primary regions of the spectrum. Each unit can be comprised of a single silver halide emulsion layer or of multiple emulsion layers sensitive to a given region of the spectrum. The layers of the element, including the layers of the image-forming units, can be arranged in various orders as is well known in the art.

The light-sensitive silver halide emulsions employed in the photographic elements of this invention can include coarse, regular, or fine grain silver halide crystals or mixtures thereof and can be comprised of such silver halides as silver chloride, silver bromide, silver bromoiodide, silver chlorobromide, silver chloroiodide, silver chorobromoiodide, and mixtures thereof. The emulsions can be, for example, tabular grain light-sensitive silver halide emulsions. The emulsions can be negative-working or direct positive emulsions. They can form latent images predominantly on the surface of the silver halide grains or in the interior of the silver halide grains. They can be chemically and spectrally sensitized in accordance with usual practices. The emulsions typically will be gelatin emulsions, although other hydrophilic colloids can be used in accordance with usual practice. Details regarding the silver halide emulsions are contained in and described in *Research Disclosure*, September 1994, Item 36544, Section I, published by Kenneth Mason Publications, Ltd., Dudley Annex, 12a North Street, Emsworth, Hampshire PO10 7DQ, ENGLAND as well as *Research Disclosure*, Item 36544, September 1994, and the references listed therein, as well as *Research Disclosure*, September 2000, Item 437013, published by Kenneth Mason Publications, Ltd., Dudley Annex, 12a North Street, Emsworth, Hampshire PO 10 7DQ, ENGLAND.

The photographic silver halide emulsions utilized in this invention can contain other addenda conventional in the photographic art. Useful addenda are described, for example, in *Research Disclosure*, Item 36544, September 1994, and *Research Disclosure*, September 2000, Item 437013, published by Kenneth Mason Publications, Ltd., Dudley Annex, 12a North Street, Emsworth, Hampshire PO10 7DQ, ENGLAND. Useful addenda include spectral sensitizing dyes, desensitizers, antifoggants, masking couplers, DIR couplers, DIR compounds, antistain agents, image dye stabilizers, absorbing materials such as filter dyes and UV absorbers, light-scattering materials, coating aids, plasticizers and lubricants, and the like.

In another embodiment of the invention the imaging elements of the invention may be coated with an inkjet or dye receiving layer. The dye receiving layer or DRL for ink jet imaging may be applied by any known methods. Such as solvent coating, or melt extrusion coating techniques. The DRL is coated over the tie layer (TL) at a thickness ranging from 0.1–10 um, preferably 0.5–5 um. There are many known formulations which may be useful as dye receiving layers. The primary requirement is that the DRL is compatible with the inks which it will be imaged so as to yield the desirable color gamut and density. As the ink drops pass through the DRL, the dyes are retained or mordanted in the DRL, while the ink solvents pass freely through the DRL and are rapidly absorbed by the TL. Additionally, the DRL formulation is preferably coated from water, exhibits adequate adhesion to the TL, and allows for easy control of the surface gloss.

For example, Misuda et al., in U.S. Pat. Nos. 4,879,166, 5,14,730, 5,264,275, 5,104,730, 4,879,166, and Japanese patents 1,095,091, 2,276,671, 2,276,670, 4,267,180, 5,024, 335, 5,016,517, discloses aqueous based DRL formulations comprising mixtures of psuedo-bohemite and certain water soluble resins. Light, in U.S. Pat. Nos. 4,903,040, 4,930,041, 5,084,338, 5,126,194, 5,126,195, 5,139,8667, and 5,147, 717, discloses aqueous-based DRL formulations comprising mixtures of vinyl pyrrolidone polymers and certain water-dispersible and/or water-soluble polyesters, along with other polymers and addenda. Butters, et al., in U.S. Pat. Nos. 4,857,386, and 5,102,717, disclose ink-absorbent resin layers comprising mixtures of vinyl pyrrolidone polymers and acrylic or methacrylic polymers. Sato, et al., in U.S. Pat. No. 5,194,317, and Higuma, et all., in U.S. Pat. No. 5,059,983, disclose aqueous-coatable DRL formulations based on poly (vinyl alcohol). Iqbal, in U.S. Pat. No. 5,208,092, discloses water-based IRL formulations comprising vinyl copolymers which are subsequently cross-linked. In addition to these examples, there may be other known or contemplated DRL formulations which are consistent with the aforementioned primary and secondary requirements of the DRL, all of which fall under the spirit and scope of the current invention.

The preferred DRL is a 0.1–10 um DRL which is coated as an aqueous dispersion of 5 parts alumoxane and 5 parts poly (vinyl pyrrolidone). The DRL may also contain varying levels and sizes of matting agents for the purpose of controlling gloss, friction, and/or finger print resistance, surfactants to enhance surface uniformity and to adjust the surface tension of the dried coating, mordanting agents, antioxidants, UV absorbing compounds, light stabilizers, and the like.

Although the ink-receiving elements as described above can be successfully used to achieve the objectives of the present invention, it may be desirable to overcoat the DRL for the purpose of enhancing the durability of the imaged element. Such overcoats may be applied to the DRL either before or after the element is imaged. For example, the DRL can be overcoated with an ink-permeable layer through which inks freely pass. Layers of this type are described in U.S. Pat. Nos. 4,686,118, 5,027,131, and 5,102,717. Alternatively, an overcoat may be added after the element is imaged. Any of the known laminating films and equipment may be used for this purpose. The inks used in the aforementioned imaging process are well known, and the ink formulations are often closely tied to the specific processes, i.e., continuous, piezoelectric, or thermal. Therefore, depending on the specific ink process, the inks may contain widely differing amounts and combinations of solvents, colorants, preservatives, surfactants, humectants, and the like. Inks preferred for use in combination with the image recording elements of the present invention are water-based, such as those currently sold for use in the Hewlett-Packard Desk Writer 560C, 840C and other printers. However, it is intended that alternative embodiments of the image-recording elements as described above, which may be formulated for use with inks which are specific to a given ink-recording process or to a given commercial vendor, fall within the scope of the present invention.

Alternatively the imaging elements useful in this invention may have a thermal dye receiving layer. The thermal dye image-receiving layer of the receiving elements of the invention may comprise, for example, a polycarbonate, a polyurethane, a polyester, polyvinyl chloride, poly(styrene-co-acrylonitrile), poly(caprolactone) or mixtures thereof. The dye image-receiving layer may be present in any amount which is effective for the intended purpose. In general, good results have been obtained at a concentration of from about 1 to about 10 g/m$^2$. An overcoat layer may be further coated over the dye-receiving layer, such as described in U.S. Pat. No. 4,775,657 of Harrison et al.

Dye-donor elements that are used with the dye-receiving element of the invention conventionally comprise a support having thereon a dye containing layer. Any dye can be used in the dye-donor employed in the invention provided it is transferable to the dye-receiving layer by the action of heat. Especially good results have been obtained with sublimable dyes. Dye donors applicable for use in the present invention are described, e.g., in U.S. Pat. Nos. 4,916,112, 4,927,803 and 5,023,228.

As noted above, dye-donor elements are used to form a dye transfer image. Such a process comprises image-wise-heating a dye-donor element and transferring a dye image to a dye-receiving element as described above to form the dye transfer image.

In a preferred embodiment of the thermal dye transfer method of printing, a dye donor element is employed which compromises a poly-(ethylene terephthalate) support coated with sequential repeating areas of cyan, magenta, and yellow dye, and the dye transfer steps are sequentially performed for each color to obtain a three-color dye transfer image. Of course, when the process is only performed for a single color, then a monochrome dye transfer image is obtained.

Thermal printing heads which can be used to transfer dye from dye-donor elements to receiving elements of the invention are available commercially. There can be employed, for example, a Fujitsu Thermal Head (FTP-040 MCS001), a TDK Thermal Head F415 HH7–1089 or a Rohm Thermal Head KE 2008-F3. Alternatively, other known sources of energy for thermal dye transfer may be used, such as lasers as described in, for example, GB No. 2,083,726A.

A thermal dye transfer assemblage of the invention comprises (a) a dye-donor element, and (b) a dye-receiving element as described above, the dye-receiving element being in a superposed relationship with the dye-donor element so that the dye layer of the donor element is in contact with the dye image-receiving layer of the receiving element.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The electrographic and electrophotographic processes and their individual steps have been well described in detail in many books and publications. The processes incorporate the basic steps of creating an electrostatic image, developing that image with charged, colored particles (toner), optionally transferring the resulting developed image to a secondary substrate, and fixing the image to the substrate. There are numerous variations in these processes and basic steps; the use of liquid toners in place of dry toners is simply one of those variations.

The first basic step, creation of an electrostatic image, can be accomplished by a variety of methods. The electrophotographic process of copiers uses imagewise photodischarge, through analog or digital exposure, of a uniformly charged photoconductor. The photoconductor may be a single-use system, or it may be rechargeable and reimageable, like those based on selenium or organic photorecptors.

In one form of the electrophotographic process of copiers uses imagewise photodischarge, through analog or digital exposure, of a uniformly charged photoconductor. The photoconductor may be a single-use system, or it may be rechargeable and reimageable, like those based on selenium or organic photoreceptors.

In one form of the electrophotographic process, a photosensitive element is permanently imaged to form areas of differential conductivity. Uniform electrostatic charging, followed by differential discharge of the imaged element, creates an electrostatic image. These elements are called electrographic or xeroprinting masters because they can be repeatedly charged and developed after a single imaging exposure.

In an alternate electrographic process, electrostatic images are created iono-graphically. The latent image is created on dielectric (charge-holding) medium, either paper or film. Voltage is applied to selected metal styli or writing nibs from an array of styli spaced across the width of the medium, causing a dielectric breakdown of the air between the selected styli and the medium. Ions are created, which form the latent image on the medium.

Electrostatic images, however generated, are developed with oppositely charged toner particles. For development with liquid toners, the liquid developer is brought into direct contact with the electrostatic image. Usually a flowing liquid is employed, to ensure that sufficient toner particles are available for development. The field created by the electrostatic image causes the charged particles, suspended in a nonconductive liquid, to move by electrophoresis. The charge of the latent electrostatic image is thus neutralized by the oppositely charged particles. The theory and physics of electrophoretic development with liquid toners are well described in many books and publications.

If a reimageable photoreceptor or an electrographic master is used, the toned image is transferred to paper (or other substrate). The paper is charged electrostatically, with the polarity chosen to cause the toner particles to transfer to the paper. Finally, the toned image is fixed to the paper. For self-fixing toners, residual liquid is removed from the paper by air-drying or heating. Upon evaporation of the solvent these toners form a film bonded to the paper. For heat-fusible toners, thermoplastic polymers are used as part of the particle. Heating both removes residual liquid and fixes the toner to paper.

The invention has numerous advantages prior art practices. These and other advantages will be apparent from the detailed description below.

The following examples illustrate the practice of this invention. They are not intended to be exhaustive of all possible variations of the invention. Parts and percentages are by weight unless otherwise indicated.

EXAMPLES

Example 1

In this example the color silver halide emulsion of the invention was coated on an imaging support material. The support material of the invention was constructed by laminating biaxially oriented polymer sheets to cellulose photographic grade paper.

The following is a description of the invention and was prepared by extrusion laminating the following top and bottom biaxially oriented polymer sheets to the photographic grade cellulose paper described below:

Top Sheet (Emulsion Side):

A composite sheet consisting of 5 layers identified as L1, L2, L3, L4, and L5. Li is the thin colored layer on the outside of the package to which the photosensitive silver halide layer was attached. L2 is the layer to which optical brightener and $TiO_2$ was added. The optical brightener used was Hostalux KS manufactured by Ciba-Geigy. A coated extrusion grade anatase $TiO_2$ (Kronos 1014) was added to both L2 and L4. Table 1 below lists the characteristics of the layers of the top biaxially oriented sheet used in this example.

TABLE 1

| Layer | Material | Thickness, μm |
|---|---|---|
| L1 | Low Density Polyethylene + color concentrate | 0.75 |
| L2 | Polypropylene + 24% $TiO_2$ + OB | 6.65 |
| L3 | Solid Clear Polypropylene | 21 |
| L4 | Polypropylene + 18% $TiO_2$ | 6.85 |
| L5 | Polypropylene | 0.76 |

Photographic grade cellulose paper base used in the invention:

Paper base was produced for the invention using a standard fourdrinier paper machine and a blend of mostly bleached hardwood Kraft fibers. The fiber ratio consisted primarily of bleached poplar (38%) and maple/beech (37%) with lesser amounts of birch (18%) and softwood (7%). Fiber length was reduced from 0.73 mm length weighted average as measured by a Kajaani FS-200 to 0.55 mm length using high levels of conical refining and low levels of disc refining. Fiber Lengths from the slurry were measured using an FS-200 Fiber Length Analyzer (Kajaani Automation Inc.). Energy applied to the fibers is indicated by the total Specific Net Refining Power (SNRP) was 127 KW hr/metric ton. Two conical refiners were used in series to provide the total conical refiners SNRP value. This value was obtained by adding the SNRPs of each conical refiner. Two disc refiners were similarly used in series to provide a total Disk SNRP. Neutral sizing chemical addenda, utilized on a dry weight basis, included alkyl ketene dimer at 0.20% addition, cationic starch (1.0%), polyaminoamide epichlorhydrin (0.50%), polyacrylamide resin (0.18%), diaminostilbene optical brightener (0.20%), and sodium bicarbonate. Surface sizing using hydroxyethylated starch and sodium chloride was also employed but is not critical to the invention. In the $_3$rd Dryer section, ratio drying was utilized to provide a moisture bias from the face side to the wire side of the sheet. The face side (emulsion side) of the sheet was then remoisturized with conditioned steam immediately prior calendering. Sheet temperatures were raised to between 76° C. and 93° C. just prior to and during calendering. The paper was then calendered to an apparent density of 1.17. Moisture levels after the calender were 7.0% to 9.0% by weight. Paper base B was produced at a basis weight of 178 g/mm$^2$ and thickness of 0.1524 mm.

The bottom biaxially oriented sheet laminated to the backside of invention base was a one-side matte finish, one-side treated biaxially oriented polypropylene sheet (25.6 μm thick) (d=0.90 g/cc) consisting of a solid oriented polypropylene layer and a skin layer of a mixture of polyethylenes and a terpolymer comprising ethylene, propylene, and butylene. The skin layer was on the bottom and the polyproylene layer and laminated to the paper.

Bottom Sheet (Backside):

A one-side matte finish, one-side treated polypropylene sheet (26 mm thick) (d=0.9 g/cc) consisting of a solid oriented polypropylene core.

Both the above top and bottom sheets were extrusion laminated to a photographic grade cellulose paper support with a clear polyolefin (25 g/m$^2$).

The top sheet used in this example was coextruded and biaxially oriented. The top sheet was melt extrusion laminated to the above cellulose paper base using a 60/40 percent blend of low density (0.0917g/cc) polyethylene and a metallocene catalyzed ethylene plastomer (SLP 9088) manufactured by Exxon Chemical Corp. The metallocene catalyzed ethylene plastomer had a density of 0.900 g/cc and a melt index of 14.0. The blend was extrusion coated from a T-slot die at 350C into a nip and between the paper base and the biaxially oriented polymer sheet. The coverage of this layer was 1 2g/m$^2$.

A coating was then applied to the laminated bottom biaxially oriented sheet on invention using a gravure coater to add the high frequency roughness to the backside. The coating consisted of an aqueous solution containing a sodium salt of styrene sulfonic acid. The coverage used was 25 mg per square meter and then dried to achieve a final web temperature between 55° C., the resultant coalesced latex material produced the desired high frequency roughness pattern. In addition to the sodium salt of styrene sulfonic acid, aluminum modified colloidal silicon dioxide particles were added to the aqueous latex material at a concentration of 50 milligrams per square meter. This further enhanced the high frequency roughness.

A layer was coated on top of the top biaxially oriented sheet (Below the image receiving layer) The nacreous pigment used was Afflair 110, a fine particle blue white pigment supplied by EM Industries, Inc. The pigment was dispersed in gelatin using typical mixing. The gel lay down was approximately 39 g/m$^2$, and the pigment weight was coated at 19.4 g/m$^2$ in this layer. The coating layer was dried and then the light sensitive silver halide emulsion was coated and dried. Later the image layer was exposed and developed using RA-4 chemistry. This example will also demonstrate a soft satin sheen to the imaging element.

Silver chloride emulsions were chemically and spectrally sensitized as described below. A biocide comprising a mixture of N-methyl-isothiazolone and N-methyl-5-chloroisthiazolone was added after sensitization.

Blue Sensitive Emulsion (Blue EM-1). A high chloride silver halide emulsion is precipitated by adding approximately equimolar silver nitrate and sodium chloride solutions into a well stirred reactor containing glutaryldiaminophenyldisulfide, gelatin peptizer and thioether ripener. Cesium pentachloronitrosylosmate(II) dopant is added during the silver halide grain formation for most of the precipitation, followed by the addition of potassium hexacyanoruthenate(II), potassium (5-methylthiazole)-pentachloroiridate, a small amount of KI solution, and shelling without any dopant. The resultant emulsion contains cubic shaped grains having edge length of 0.6μm. The emulsion is optimally sensitized by the addition of a colloidal suspension of aurous sulfide and heat ramped to 60° C. during which time blue sensitizing dye BSD-4, potassium hexchloroiridate, Lippmann bromide and 1-(3-acetamidophenyl)-5-mercaptotetrazole were added.

Green Sensitive Emulsion (Green EM-1): A high chloride silver halide emulsion is precipitated by adding approximately equimolar silver nitrate and sodium chloride solutions into a well stirred reactor containing, gelatin peptizer and thioether ripener. Cesium pentachloronitrosylosmate(II) dopant is added during the silver halide grain formation for most of the precipitation, followed by the addition of potassium (5-methylthiazole)-pentachloroiridate. The resultant emulsion contains cubic shaped grains of 0.3 μm in edge length size. The emulsion is optimally sensitized by the addition of glutaryldiaminophenyldisulfide, a colloidal suspension of aurous sulfide and heat ramped to 55° C. during which time potassium hexachloroiridate doped Lippmann bromide, a liquid crystalline suspension of green sensitizing dye GSD-1, and 1-(3-acetamidophenyl)-5-mercaptotetrazole were added.

Red Sensitive Emulsion (Red EM-1): A high chloride silver halide emulsion is precipitated by adding approximately equimolar silver nitrate and sodium chloride solutions into a well stirred reactor containing gelatin peptizer and thioether ripener. During the silver halide grain formation, potassium hexacyanoruthenate(II) and potassium (5-methylthiazole)-pentachloroiridate are added. The resultant emulsion contains cubic shaped grains of 0.4$\mu$m in edge length size. The emulsion is optimally sensitized by the addition of glutaryldiaminophenyldisulfide, sodium thiosulfate, tripotassium bis {2-[3-(2-sulfobenzamido)phenyl]-mercaptotetrazole} gold(I) and heat ramped to 64° C. during which time 1-(3-acetamidophenyl)-5-mercaptotetrazole, potassium hexachloroiridate, and potassium bromide are added. The emulsion is then cooled to 40° C., pH adjusted to 6.0 and red sensitizing dye RSD-1 is added.

Coupler dispersions were emulsified by methods well known to the art and the following layers were coated on the following support:

The following light sensitive silver halide imaging layers were utilized to prepare photographic print materials utilizing the invention support material and the control support material. The following imaging layers were coated utilizing curtain coating:

| Layer | Item | Laydown (g/m$^2$) |
|---|---|---|
| Layer 1 | Blue Sensitive Layer | |
| | Gelatin | 1.3127 |
| | Blue sensitive silver (Blue EM-1) | 0.2399 |
| | Y-4 | 0.4143 |
| | ST-23 | 0.4842 |
| | Tributyl Citrate | 0.2179 |
| | ST-24 | 0.1211 |
| | ST-16 | 0.0095 |
| | Sodium Phenylmercaptotetrazole | 0.0001 |
| | Piperidino hexose reductone | 0.0024 |
| | 5-chloro-2-methyl-4-isothiazolin-3-one/2-methyl-4-isothiazolin-3-one(3/1) | 0.0002 |
| | SF-1 | 0.0366 |
| | Potassium chloride | 0.0204 |
| | Dye-1 | 0.0148 |
| Layer 2 | Interlayer | |
| | Gelatin | 0.7532 |
| | STA | 0.1076 |
| | S-3 | 0.1969 |
| | 5-chloro-2-methyl-4-isothiazolin-3-one/2-methyl-4-isothiazolin-3-one(3/1) | 0.0001 |
| | Catechol disulfonate | 0.0323 |
| | SF-1 | 0.0081 |
| Layer 3 | Green Sensitive Layer | |
| | Gelatin | 1.1944 |
| | 1) | 0.1011 |
| | M-4 | 0.2077 |
| | Oleyl Alcohol | 0.2174 |
| | S-3 | 0.1119 |
| | ST-21 | 0.0398 |
| | ST-22 | 0.2841 |
| | Dye-2 | 0.0073 |
| | 5-chloro-2-methyl-4-isothiazolin-3-one/2-methyl-4-isothiazolin-3-one(3/1) | 0.0001 |
| | SF-1 | 0.0236 |
| | Potassium chloride | 0.0204 |
| | Sodium Phenylmercaptotetrazole | 0.0007 |
| Layer 4 | M/C Interlayer | |
| | Gelatin | 0.7532 |
| | ST-4 | 0.1076 |
| | S-3 | 0.1969 |
| | Acrylamide/t-Butylacrylamide sulfonate copolymer | 0.0541 |
| | Bis-vinylsulfonylmethane | 0.1390 |
| | 3,5-Dinitrobenzoic acid | 0.0001 |
| | Citric acid | 0.0007 |
| | Catechol disulfonate | 0.0323 |
| | 5-chloro-2-methyl-4-isothiazolin-3-one/2-methyl-4-isothiazolin-3-one(3/1) | 0.0001 |
| Layer 5 | Red Sensitive Layer | |
| | Gelatin | 1.3558 |
| | Red Sensitive silver (Red EM-1) | 0.1883 |
| | IC-35 | 0.2324 |
| | IC-36 | 0.0258 |
| | UV-2 | 0.3551 |
| | Dibutyl sebacate | 0.4358 |
| | S-6 | 0.1453 |
| | Dye-3 | 0.0229 |
| | Potassium p-toluenethiosulfonate | 0.0026 |
| | 5-chloro-2-methyl-4-isothiazolin-3-one/2-methyl-4-isothiazolin-3-one(3/1) | 0.0001 |
| | Sodium Phenylmercaptotetrazole | 0.0005 |
| | SF-1 | 0.0524 |
| Layer 6 | UV Overcoat | |
| | Gelatin | 0.8231 |
| | UV-1 | 0.0355 |
| | UV-2 | 0.2034 |
| | ST-4 | 0.0655 |
| | SF-1 | 0.0125 |
| | S-6 | 0.0797 |
| | 5-chloro-2-methyl-4-isothiazolin-3-one/2-methyl-4-isothiazolin-3-one(3/1) | 0.0001 |
| Layer 7 | SOC (top most layer) | |
| | Gelatin | 0.7560 |
| | Ludox AM ™ (colloidal silica) | 0.3241 |
| | Syloid 72 ™ (Glass beads) micrometers Particle Size = 2 | 0.1510 |
| | Polydimethylsiloxane (DC200 ™) | 0.0202 |
| | 5-chloro-2-methyl-4-isothiazolin-3-one/2-methyl-4-isothiazolin-3-one(3/1) | 0.0001 |
| | SF-2 | 0.0032 |
| | Tergitol 15-S-5 ™ (surfactant) | 0.0020 |
| | SF-1 | 0.0081 |
| | Aerosol TO ™ (surfactant) | 0.0029 |

The structure of this invention typically is as follows:

| |
|---|
| Layer 7 SOC (contains roughness enhancing material to produce lustrous satin sheen in combination with nacreous pigment) |
| Layer 6 UV Overcoat |
| Layer 5 Red Sensitive Layer |
| Layer 4 M/C Interlayer |
| Layer 3 Green Sensitive Layer |
| Layer 2 Interlayer |
| Layer 1 Blue Sensitive layer |
| LA: Afflair 110 Pigment in gelatin |
| LB: Low density Polyethylene + blue tint |
| LC: Polypropylene + 24% $TiO_2$ + OB |
| LD: Solid Polypropylene |
| LE: Polypropylene + 18% $TiO_2$ |
| LF: Polypropylene |
| LG: 60/40 LDPE and Plastomer + 12.5% $TiO_2$ |
| LH: Paper Base |
| LI: 60/40 LDPE and Plastomer |
| LJ: Matte biaxially oriented backside film |
| LK: Antistat |

Example 2

In this example the color silver halide emulsion of the invention was coated on an imaging support material. The support material of the invention was constructed by laminating biaxially oriented voided sheets to cellulose photographic grade paper. It is identical to Example 1 except the top biaxially oriented sheet as describe in Table 1 is voided layer LD.

Example 3 (Glossy Nacreous Control)

In this example the color silver halide emulsion of the invention was coated on an imaging support material. The support material of the invention was constructed by laminating biaxially oriented voided sheets to cellulose photographic grade paper. It is identical to Example 1 except the top biaxially oriented sheet as describe in Table 1 is voided in layer LD and the LC layer has no white pigment ($TiO_2$). Furthermore there is no nacreous pigment on top of the base substrate or under the emulsion (Layer LA).

Example 4

This example is similar to example 1 except the light sensitive silver halide layer is replaced with an inkjet receiving layer as describe above. The use of pigmented inks or excessively high density laydown of dye based inks may tend to obscure the nacreous effect.

Example 5

This proposed example is similar to example 2 except the light sensitive silver halide emulsion is replaced with a thermal dye-receiving layer. The imaging dyes are transfer from to the receiving layer further utilizing a three color donor. The system used was a commercially available printer model 8670PS from Eastman Kodak Company. The dye density should be printed less with less than 60% reflection density as measured by a Status A Densitometer.

Example 6

This sample was similar to example 1 except the top surface roughness was 4.8 micrometers. This was achieved by Syloid 72 from a 2 micrometer average article size to a 4.0 micrometer average and increasing the concentration from 0.151 $g/m^2$ to 0.415 $g/m^2$.

Example 7

This sample was the same as example 3 but the top Layer 7 SOC was roughened in the same manner as example 6.

TABLE 2

| Example | 20 Degree Garadener Gloss | Flop | Roughness Ra | Color Purity | Apparent Depth of Image | Nacreous Glossy/ Metallic Appearance | Lustrous Iridescence/ Satin Appearance |
|---|---|---|---|---|---|---|---|
| 1 | 15 | 19 | 1.7 | No | No | No | Yes |
| 2 | 19 | 21 | 1.5 | No | No | No | Yes |
| 3 (control) | 45 | 52 | 0.7 | Yes | Yes | Yes | No |
| 4 | 15 | 18 | 1.5 | Not Rated | No | No | Yes |
| 5 | 21 | 20 | 1.6 | Not Rated | No | No | Yes |
| 6 | 2 | 4 | 4.8 | No | No | No | No |
| 7 | 2 | 2 | 5.0 | No | No | No | No |

As can be seen from the data in Table 2 examples 1,2,4 and 5 all have a lustrous satin appearance to them while the control sample 3 and 6 do not exhibit the satin sheen. The control sample has a very high level of gloss and FLOP and has a more metallic nacreous appearance than a lustrous iridescence satin appearance. Example 6 while containing a nacreous pigment has a roughened top surface that eliminates the nacreous appearance. Also noted in this table is the fact that those samples containing the nacreous pigment do not exhibit the color purity of that observed when compared against control sample 3. This measure was obtained from visual examination of the sample using an image with a high amount of yellow color. The control sample 3 was a lemon yellow color while the other samples were shifted in color appearance to a reddish/orange yellow. This shift in color appearance is believed to be related to the nacreous pigment in Layer LA and also white pigment in Layer LC. As noted in the Table 2 examples 4 and 5 were not rated for this test because they had a different dye set than the photographic examples 1,2,3 and 6. Example 7 also did not exhibit the color purity.

As noted in the roughness average data samples 1–5 were controlled to a Ra of less than 2.0 while example 6 was roughness to 4.8 Ra. When comparing this data, to the nacreous/glossy metallic appearance and the lustrous satin appearance, it is noted that the addition of high level of roughness shuts down the lustrous iridescence satin appearance. Example 7 demonstrates that even when a nacreous imaging element without a nacreous pigment is roughened in the top surface, the high gloss metallic appearance can be shut down.

Also noted from Table 2 is the gloss data shows that when the nacreous pigment is not presence in the control sample 3 when compared against examples 1,2,4,5 and 6 there is significantly higher gloss. This data indicates that the nacreous pigment provides a slightly roughened surface that subdues the gloss slightly but still retains a lustrous sheen.

The apparent depth of image was a relative visual assessment of the images. The high level of gloss in example 3 was the only sample to show the relative depth of image. The data suggest that the slightly roughened surface and low gloss reduces the appearance of depth.

The invention has been described in detail with particular reference to certain preferred embodiments thereof, but it will be understood that variations and modifications can be effected within the spirit and scope of the invention.

What is claimed is:

1. An imaging element comprising nacreous pigment and having a top surface roughness of between 0.2 and 2.0 micrometers.

2. An imaging element of claim 1 wherein said imaging element has a surface gloss of between 6 and 30 20° Gardner units.

3. An imaging element of claim 1 wherein said imaging element has a flop of between 4 and 25.

4. An imaging element of claim 1 wherein said imaging element comprises in order at least an image receiving layer, a layer comprising nacreous pigment, and a base substrate.

5. The imaging element of claim 4 wherein said base substrate has a b of between 7.0 and −7.0.

6. The imaging element of claim 4 wherein said base substrate has a top surface roughness of between 0.3 and 2.2 micrometers.

7. The imaging element of claim 4 wherein said nacreous pigment is in the image receiving layer.

8. The imaging element layer of claim 1 wherein said nacreous pigment is in more than one layer.

9. The imaging element of claim 4 wherein said image receiving layer comprises light sensitive silver halide.

10. The imaging element of claim 4 wherein said image receiving layer comprises inkjet receiving materials.

11. The imaging element of claim 1 wherein the top layer having a surface roughness of between 0.2 and 2.0 micrometers comprises particles with a size of between 0.2 and 15.0 micrometers.

12. The imaging element of claim 1 wherein said top surface with a roughness of between 0.2 and 2.0 micrometers is on a surface layer comprising at least one material selected from the group consisting of silica, silicon dioxide, glass beads, at least two or more immessible polymers.

13. The imaging element of claim 12 wherein said top surface roughness of between 0.2 and 2.0 micrometers is on a top surface layer comprising silica in an amount between 25 mg/n and 400 $mg/m^2$.

14. The imaging element of claim 1 wherein said top surface roughness is provided by the nacreous pigment.

* * * * *